United States Patent [19]

Higuchi

[11] Patent Number: 4,565,119

[45] Date of Patent: Jan. 21, 1986

[54] VANE-TYPE ROTARY ACTUATOR

[75] Inventor: Yasuo Higuchi, Aichi, Japan

[73] Assignee: Kabushiki Kaisha Japanlicensor, Japan

[21] Appl. No.: 622,659

[22] Filed: Jun. 20, 1984

Related U.S. Application Data

[63] Continuation of Ser. No. 389,928, Jun. 18, 1982, abandoned.

[51] Int. Cl.[4] ..... F01C 9/00

[52] U.S. Cl. ..... 92/125; 92/121; 277/DIG. 6

[58] Field of Search ..... 92/120, 121, 123, 124, 92/125, 122; 418/144; 277/DIG. 6; 91/376 A, 167 A, 339, 340

[56] References Cited

U.S. PATENT DOCUMENTS

| | | | |
|---|---|---|---|
| 2,189,088 | 2/1940 | Thompson | 418/144 X |
| 3,008,425 | 11/1961 | Chambers | 418/144 X |
| 3,032,020 | 5/1962 | Sneen | 92/125 |
| 3,049,103 | 8/1962 | Dumm | 92/122 |
| 3,359,871 | 12/1967 | Kamman | 92/121 |
| 3,737,169 | 6/1973 | Glynn | 277/DIG. 6 |
| 3,750,535 | 8/1973 | Higuchi | 92/121 |
| 3,919,448 | 11/1975 | Dufresne | 277/DIG. 6 |
| 4,345,509 | 8/1982 | Bridwell et al. | 92/121 |

OTHER PUBLICATIONS

*Mechanical Properties of Polymers*, L. Nielsen, Reinhold Publishing Corp., N.Y., 1962.

*Seals and Sealing Handbook*, R. Warring, Trade & Technical Press Ltd., England, (date unknown).

*Primary Examiner*—Robert E. Garrett

*Assistant Examiner*—Richard S. Meyer

*Attorney, Agent, or Firm*—McGlew and Tuttle

[57] ABSTRACT

A vane-type rotary actuator in which a disc like seal member made of an elastic material with a hole provided in the middle thereof is pressed in place in contact with a flange surface. With seal material thus somewhat deformed in the radial direction thereof, pressure required for sealing is generated at the inner surface of a cylinder and the outer surface of a shaft cylinder.

2 Claims, 2 Drawing Figures

VANE-TYPE ROTARY ACTUATOR

This is a continuation of application Ser. No. 389,928 filed June 18, 1982 now abandoned.

BACKGROUND OF THE INVENTION

This invention relates to a vane-type rotary actuator.

SUMMARY OF THE INVENTION

It is an object of the invention to provide a vane-type rotary actuator in which leakage from the outer circumference of a slidably arranged packing is perfectly prevented by forming a continuous sliding surface which has the same cross-section as the outer circumference of the packing.

The object and features of the invention will become apparent from the following detailed description of a preferred embodiment thereof taken in connection with the accompanying drawings.

BRIEF DESCRIPTION OF THE INVENTION

DETAILED DESCRIPTION OF PREFERRED EMBODIMENT

Figure 2:
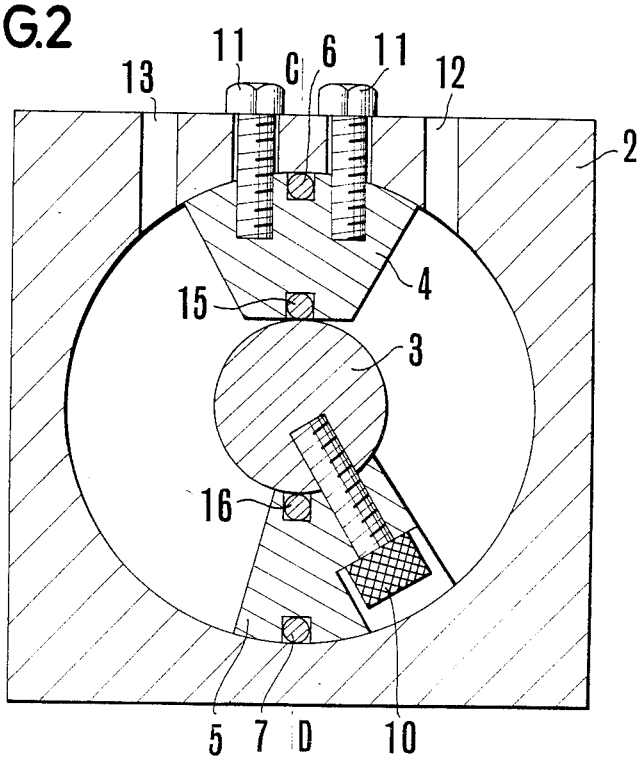
FIG. 2 is a sectional view taken on line A-B of FIG. 1.

Referring to FIG. 2, a fixed packing 6 is attached to the groove 15 of a fixed vane 4, which is attached to a cylinder 2 with a bolt 11. A slidable packing 7 is attached to the groove 16 of a moving vane 5, which is attached to a shaft 3 with a bolt 10. Packing 6 and 7 both have radial portions that are connected to extend continuously around respective vanes 4 and 5.

Figure 1:
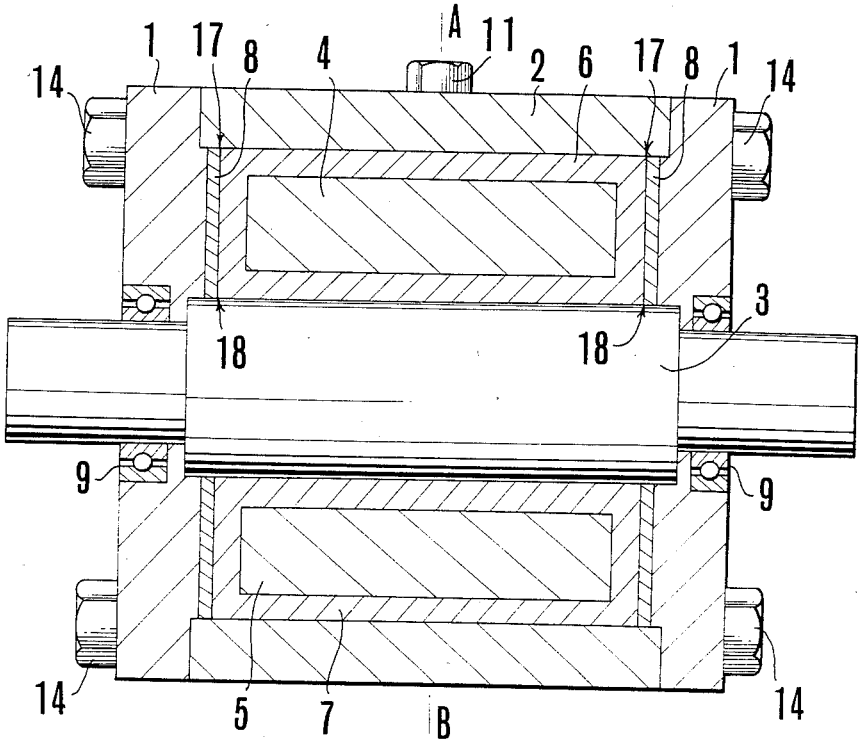
FIG. 1 is a sectional view showing an embodiment of the invention.

Referring now to FIG. 1, each of the seal plates 8 is arranged with its periphery slightly compressed by the inner surface of the cylinder 2 in the radial direction thereof while the middle hole thereof slightly expands from the outer circumferential surface of the cylinder portion of a shaft 3. The shaft 3 is rotatably supported by a bearing 9 in the middle of the cylinder 2. The inner circumferential face of the seal plate 8 and the cylinder surface of the shaft 3 are slidably engaged. Each of end covers 1 disposed at both ends is combined with the cylinder 2 by means of bolts 14.

Again referring to FIG. 2, the cylinder 2 is provided with inlet and outlet ports 12 and 13 for a fluid. The shaft which has the moving vane 5 mounted thereon is arranged to be rotatable in the right and left directions according as the fluid is allowed to flow in and out through the fluid inlet and outlet ports 12 and 13.

A feature of the invention resides in the arrangement of each seal plate 8. The seal plate 8 has the outer circumferential edge 17 and the inner circumferential edge 18 thereof sharply formed and is set in position with some degree of deformation (compression) thereon in the radial direction. The arrangement prevents any leakage from occurring between the cylinder surface and the pressed contact face of the seal plate 8 both in the axial and circumferential directions. The faces adjoining the packings 6 and 7 are arranged to be perfectly continuous. In this case, deformation inflicted on the seal plate 8 by fluid pressure is only in the direction of plate thickness thereof and, since the outer and inner circumferential faces of the seal plate 8 are slidable in the direction of the plate thickness, the edge portions 17 and 18 of the seal plate remain undeformed.

Further, an eccentric motion of the shaft 3 due to machining tolerance and a clearance of the bearing 9 is absorbed by elastic deformation of the seal plate 8 in the radial direction thereof. Therefore, the continuous faces of the seal plate 8 remains undisturbed by such an eccentric motion.

The seal plate 8 according to the present invention is made of a material preferably selected from the group consisting of nylon, polyethylene of ultrahigh molecular weight (UHMW), poly-urethane rubber, etc. Conceivable materials usable for this purpose include a complex consisting of polyurethane rubber and fluororesin, a complex consisting of a metal and a synthetic rubber and the like.

What we claim:

1. A vane-type rotary actuator comprising:

a cylindrical housing defining a cylindrical space having an axial direction and a radial direction, said housing defining an axially extending cylindrical metal wall extending around said cylindrical space and a pair of spaced apart radially extending radial metal walls on opposite ends of said cylindrical space;

a shaft having an outer axially extending metal shaft surface, said shaft rotatably mounted to said cylindrical housing extending through a center of said cylindrical space, said cylindrical metal wall and said outer metal shaft surface defining an annular vane space therebetween, said pair of radial metal walls extending between said cylindrical metal wall and said metal outer shaft surface and bounding opposite ends of said annular vane space;

a pair of radially extending seal plates each engaged over a respective one of said radial metal walls, each seal plate being made of elastic material and being radially elastically compressed in position by said cylindrical metal wall, each seal plate having an outer cylindrical surface compressedly engaged against said cylindrical metal wall and an inner cylindrical surface defining a hole through said seal plate and compressedly engaged against said outer metal shaft surface, said seal plates having radial planar walls facing said cylindrical space and against which said fixed packing and said slidable packing bear, said seal plates being each made of a material chose from the group consisting of nylon, UHMW polyethylene, poly-urethane rubber, a complex of poly-urethane rubber and fluoro-resin, and a complex of metal and synthetic rubber;

a fixed vane connected to said fixed cylindrical housing an extending into said vane space;

a fixed packing connected to said fixed vane having an axially extending portion engaged against said outer metal shaft surface and a pair of radially extending portions connected to said axially extending portion each bearing against one of said seal plates;

a movable vane connected to said shaft and extending into said vane space;

a slidable packing connected to said movable vane having an axially extending portion bearing against said cylindrical metal wall and a pair of radially extending portions connected to said axially extending portion and each bearing against one of said seal plates;

said fixed packing including a second axially extending portion bearing against said cylindrical metal wall and connected to said pair of radially extending portions of said fixed packing to form a closed packing around said fixed vane, said slidable packing including a second axially extending portion bearing against said outer metal shaft surface and connected to said pair of radially extending portions of said slidable packing to form a closed packing around said movable vane.

2. An actuator according to claim 1, including bearing members connected between said shaft and said housing for rotatably mounting said shaft to said housing.

* * * * *